United States Patent [19]

Wolff

[11] 4,456,439

[45] Jun. 26, 1984

[54] HIGH PRESSURE PLUNGER PUMP

[75] Inventor: Horst Wolff, Geretsried, Fed. Rep. of Germany

[73] Assignee: Speck-Kolbenpumpen-Fabrik, Fed. Rep. of Germany

[21] Appl. No.: 318,266

[22] Filed: Nov. 4, 1981

[30] Foreign Application Priority Data

Nov. 6, 1980 [DE] Fed. Rep. of Germany ..... 3041933

[51] Int. Cl.[3] ..... F04B 39/14; F04B 21/00; F04B 23/06

[52] U.S. Cl. ..... 417/454; 417/539; 92/171; 92/86.5

[58] Field of Search ..... 92/86.5, 171; 417/454, 417/539, 273

[56] References Cited

U.S. PATENT DOCUMENTS

| | | | |
|---|---|---|---|
| 2,678,609 | 5/1954 | Ashton | 92/86.5 |
| 3,191,544 | 6/1965 | Szekely | 417/454 |
| 3,372,648 | 3/1968 | Hammelmann | 92/171 |
| 3,373,695 | 3/1968 | Yohpe | 417/569 |
| 3,413,929 | 12/1968 | Cook et al. | 92/171 |
| 3,610,110 | 10/1971 | Schaaf | 92/171 |
| 3,792,939 | 2/1974 | Zallis | 417/539 |
| 4,087,213 | 5/1978 | Hadama | 417/539 |
| 4,140,442 | 2/1979 | Mulvey | 417/454 |
| 4,146,355 | 3/1979 | Broker | 417/454 |
| 4,184,817 | 1/1980 | Pareja | 417/539 |
| 4,264,286 | 4/1981 | Reinkemeyer | 417/539 |
| 4,277,229 | 7/1981 | Pacht | 417/539 |

*Primary Examiner*—William L. Freeh

[57] ABSTRACT

A high pressure plunger pump, in particular for forwarding water and water with additives, comprises a plurality of plungers 20 which are driven by a crankshaft journalled in a drive housing 10. The free ends of the plungers 20 are each guided in respective pump chambers 22 of an induction-discharge housing 12 which is connected to the drive housing 10. The induction-discharge housing 12 is a one piece housing of generally L-shaped cross-section. The pump chambers 22 are arranged in one limb of the L-shaped housing and communicate with an induction chamber 27 via spring biased inlet valves 27 provided in axial extensions of the pump chambers. A discharge chamber 31 extends through the other limb of the L-shaped housing and is fed from the pump chambers via outlet valves 29. Both the inlet and the outlet valves 25, 29 are secured in position by respective threaded plugs. The use of a one piece L-shaped housing brings a number of substantial benefits. The housing is particularly convenient to manufacture, is very stiff, allows a significant weight saving, can be conveniently attached to the drive housing and allows ready access to all components for servicing and repair purposes. In a preferred arrangement high and low pressure seal 23, 34 are associated with each of the plungers 20 and the low pressure seals are arranged in a scavenge circulation established by connection passages 32, 32' extending between the induction chamber 27 and chambers accommodating the low pressure seals 34.

16 Claims, 3 Drawing Figures

HIGH PRESSURE PLUNGER PUMP

Figure 1:
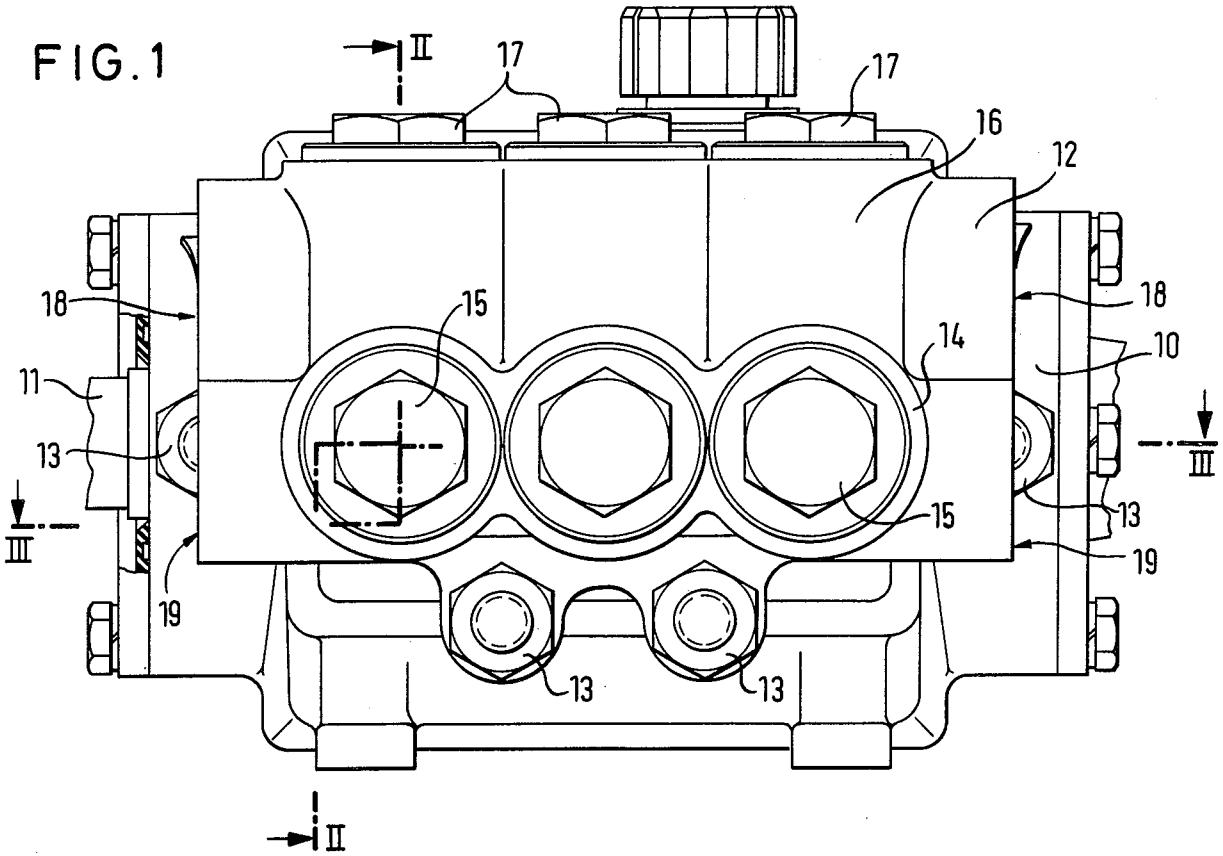

The invention relates to a high pressure plunger pump for forwarding liquids and has particular reference to a high pressure pump for forwarding water and water with additives.

Known high pressure pumps of this kind are used extensively in industrial process engineering and particularly for high pressure cleaners, automatic car washers, steam cleaners, for cleaning screens in the paper industry and for reverse osmosis plants. They are suitable for forwarding clean water with additives such as are customary for cleaning vehicles and machine parts and also for forwarding water with added pest control agents, plant protection agents and the like.

These high pressure pumps are not only required to be reliable in operation and economical, they are also required to have a long working life and to be easy to service.

In a known pump of this kind (U.S. Pat. No. 4,140,442) the pump comprises a drive housing, an induction-discharge housing mounted on said drive housing, said induction-discharge housing having a plurality of generally cylindrical pump chambers arranged alongside one another, a plurality of plungers having free ends extending into respective pump chambers of said induction-discharge housing and a crankshaft journalled in said drive housing for producing reciprocating movement of said plungers in said pump chambers. The induction-discharge housing is provided with induction and discharge chambers and spring biased inlet and outlet valves are respectively disposed between the induction and discharge chambers and the pump chambers. The inlet valves are arranged alongside one another in axial extensions of the pump chambers and the outlet valves are arranged alongside one another to one side of said pump chambers.

This known arrangement is fundamentally sound because it results in very short flow paths from the induction chamber through the pump chambers to the discharge chamber in contrast, for example, to other known arrangements such as the pump of DE-AS Pat. No. 1 193 017. This in turn minimizes the possibility of cavitation and thus allows higher outputs while minimizing the danger of damage to the pump through cavitation.

The known arrangement is however relatively complicated to manufacture, is not as compact as it might be, is wasteful of material and has a number of joint faces which define potential leak paths and which require careful sealing.

These disadvantages arise principally because the induction-discharge housing is manufactured in three separate pieces with the induction and discharge chambers being provided in separate induction and discharge heads which are bolted onto a basic housing. The inlet and discharge heads of the known arrangement are used to trap the inlet and outlet valves in seatings formed in the basic housing. This arrangement, particularly in respect of the inlet valves, means that the bores which ultimately define the pump chambers have a number of different stepped diameters and must indeed be machined from both sides. Furthermore, the arrangement is such, that access to the individual valves is only possible by removing the cylinder heads and access to the plungers and seals is only possible by removing the whole induction discharge housing assembly from the drive housing. The arrangement also includes a multitude of parts which can easily be lost during servicing.

Accordingly, the principle object of the present invention is to provide an induction discharge housing for a high pressure plunger pump which is straightforward and economical to manufacture, which allows easy access to all the component parts for servicing and which is compact, resulting in greater stiffness and a saving of material.

It is a further object of the present invention to provide a high pressure plunger pump which, while ensuring a reliable and at least substantially leak-free manner of operation, has a particularly long working life and which enables worn parts to be exchanged without problem and without particular specialist knowledge should this be necessary after an appropriate period of operation.

In order to satisfy these objects there is provided a high pressure plunger pump comprising a drive housing, an induction-discharge housing mounted on said drive housing, said induction-discharge housing having a plurality of generally cylindrical pump chambers arranged alongside one another, a plurality of plungers having free ends extending into respective pump chambers of said induction-discharge housing, a crankshaft journalled in said drive housing for producing reciprocating movement of said plungers in said pump chambers, induction and discharge chambers for said induction-discharge housing and spring biased inlet and outlet valves respectively disposed between the induction and discharge chambers and the pump chambers, with said inlet valves being arranged alongside one another in axial extensions of the pump chambers and the outlet valves being arranged alongside one another to one side of said pump chambers, or vice versa, and wherein said induction-discharge housing is a one piece housing of substantially L-shaped cross-section when viewed in a plane at right angles to said crankshaft with each of said inlet and outlet valves being secured in position by a respective threaded plug.

This basic arrangement brings a large number of advantages. First of all the use of separate induction and discharge heads is avoided so that leakage at the joint faces between these heads and the base housing simply cannot occur. Secondly, the housing can be manufactured by relatively simple machine tools which only need to be capable of carrying out boring and facing operations in three directions at right angles to one another. Thirdly, as separate heads do not need to be attached to a base housing there is also no need to provide threaded bores for the fixing bolts and the absence of fixing bolts for these components allows the individual pump chambers to be arranged very close together which provides a compact arrangement and also increases the stiffness of the induction-discharge housing. Fourthly, a further saving in material is achieved in the blank used to manufacture the housing. This blank may be either a casting or a forging in a material such as an engineering brass or an aluminium bronze. This material saving is achieved because the induction and discharge chambers can extend through the induction discharge housing transverse to and intersecting the axes of the inlet and outlet valves respectively. In this way the passages in which the inlet and outlet valves are located themselves form a part of the induction and discharge chambers. In a preferred embodiment the induction and discharge chambers are simply cylindrical bores and it will be seen that in producing these bores it is only necessary to bore through the intermediate wall portions between the individual inlet valves and between the individual outlet valves respectively.

The induction and discharge connections to the induction-discharge chambers are then conveniently provided at the end faces of the induction discharge housing directly at the ends of the induction and discharge chambers and the threads required for these induction-discharge connections can be cut on the same machine setting as is used to bore the passages for the induction and discharge chambers.

In a specially preferred embodiment at least that part of each plunger which engages in the associated pump chamber is provided with an exchangeable sleeve which is fixed on the plunger by means of a threaded fastener at the end face of the plunger, with this sleeve being exchangeable through the associated pump chamber extension. In an arrangement of this kind the sleeve can be exchanged simply by releasing the threaded plug and the valve located in the associated pump chamber extension.

The L-shaped induction-discharge housing is preferably connected to the drive housing via lugs at the base of the induction-discharge housing adjacent the drive housing.

In a particularly preferred arrangement threaded fasteners are used to secure the induction-discharge housing to the drive housing via the lugs. First and second threaded fasteners are arranged at the ends of the induction-discharge housing in a plane containing the pump chambers and further threaded fasteners are arranged to one side of the pump chambers on the opposite side to the valves.

In this arrangement there is no need for any threaded fastener to pass through the induction-discharge housing between the individual pump chambers and this further simplifies the raw material blank for the induction-discharge housing and also results in increased compactness and a further saving of weight.

The working life of a high pressure plunger pump between servicing intervals is often limited by the life of the seals used to prevent leakage past the plungers. In fact a certain degree of leakage is normally considered desirable because this leakage also produces a degree of lubrication and prevents excessive rates of wear of the seals. In many prior art pumps such leakage manifests itself as a continuous drip from beneath the induction-discharge housing. For some purposes such as high pressure cleaning of building fassades such drips are of no consequence. There are however a whole range of applications, for example high pressure plunger pumps in ship engine rooms or situations in which poisonous chemicals are being pumped, in which such leakage is highly undesirable.

It is thus a further principal object of the present invention to provide a high pressure plunger pump which has the twin advantages of no leakage and long seal life.

In order to satisfy this further object respective high and low pressure seals are associated with each plunger with the high pressure seals being arranged in the induction-discharge housing around said plungers adjacent said drive housing and with the low pressure seals being positioned in a scavenge circulation established by first and second connection passages extending between chambers accommodating the low pressure seals and the induction chamber.

These measures result in a series of advantages. In the first place lubricant free operation is possible as a result of the self-lubrication of the high and low pressure seals which necessarily takes place because of the presence of the liquid medium. Secondly, the liquid leaking past the high pressure seal can no longer escape from the apparatus but is instead picked up by the scavenge circulation. Thirdly, a desired amount of leakage through the high pressure seal can be provided so that undesirable wear of the high pressure seal can be avoided. Furthermore, the seals can indeed be cooled by the scavenge circulation which means that the permissible temperature of the medium which is to be forwarded can be increased if desired.

The concept of arranging the low pressure seals in a scavenge circulation is indeed known per se, for example from DE-OS Pat. No. 28 18 339. The known scavenge circulation is however produced in a slightly different way. In the known arrangement a single passage passes from the induction chamber to an annular space formed between the high and low pressure seals. The precise manner of operation is not explained but it is assumed that the scavenge circulation is produced by liquid supplied to the annular space being transported into the pump chambers by a pumping effect of the plungers which is contrived to move the liquid past the high pressure seals. An arrangement of this kind must be very difficult to achieve because any significant circulation, such as is required to avoid bubble formation and overheating and damage to the seals, will require a large flow past the high pressure seal. This situation is however equivalent to saying that the high pressure seal is not a tight seal and this means that the performance of the pump itself will be significantly reduced.

It will be appreciated that the scavenge circulation proposed by the present invention does not pass through the high pressure seals but instead through the first and second connection passages. It is indeed surprizing that the use of two connection passages both of which communicate with the induction chamber results in a scavenge circulation being established. This is however the case and has been readily demonstrated in laboratory tests.

It is thought that the scavenge circulation occurs as a result of either the pulsation in the induction chamber or the pressure drop which exists in this chamber. The feeding of the circulation from the induction chamber brings the additional advantages that the cross-section of the connection passages is uncritical as a result of the low pressure which exists in the circulation circuit and that the desired lubrication and cooling effects can be achieved even with only a relatively small quantity of water circulating in the scavenge or irrigation circuit.

The low pressure seals are conveniently arranged between the induction-discharge housing and the drive housing and are preferably arranged in a carrier part, with recesses formed in this carrier part to accommodate the low pressure seals being connected together via shallow channels for the purpose of ensuring the scavenge circulation.

This carrier part is usefully sealingly retained against the induction-discharge housing by being clamped between the drive housing and the suction discharge housing. The connection passages between the induction chamber and the carrier part preferably open into the side edge regions both at the induction chamber side and also at the carrier part side so that the pressure difference which occurs in the induction chamber and which ensures the circulation of the liquid over the low pressure seals, or the pulsation which bring about a corresponding effect, can be ideally utilized and so that the liquid is caused to wash around the low pressure seals in a troublefree manner.

The direct accessibility of the inlet and outlet valves brings considerable advantages with regard to the overall construction of the pump and particularly with regard to its servicing.

It is particularly advantageous if the high pressure seals are located at the bases of cylindrical bores formed in said induction discharge housing and defining, at least in part, said pump chambers with each high pressure seal being braced against the base of the associated cylindrical bore via a spacer member and a valve mount of one of the associated valves by means of a respective one of said threaded plugs, and if these coaxially arranged components can be interchanged by removing said threaded plug. The ability to exchange the high pressure seals and the valves without having to remove the induction-discharge housing or parts of the induction-discharge housing, and without having to remove the induction and/or discharge lines, is in practice of great advantage to the user because the exchange of parts can be carried out rapidly and without difficulty without any particular specialist knowledge.

In accordance with a special feature of the invention each distance element comprises a compression spring and in this case the working position of the associated threaded plug is defined by a fixed abutment.

The use of a compression spring in conjunction with a fixed abutment for the threaded plug means that the bias pressure acting on the high pressure seal can be accurately predetermined, that any manufacturing tolerances which may possibly be present can be automatically compensated and that temperature expansions of the high pressure seal can be taken up. As the predetermined bias conditions are necessarily attained and overtightening is not possible as a result of the fixed abutment of the threaded plug, reassembly is also simplified and it is ensured that the original predetermined conditions are always reestablished after exchanging worn parts. Further advantageous embodiments of the invention are given in the subclaims.

Finally, it will be appreciated that the scavenge circulation proposed in this application could also be used independently of the specific arrangement of the induction-discharge housing. Accordingly, the present invention also envisages a high pressure plunger pump for forwarding liquid at high pressures, the pump comprising a drive housing, an induction-discharge housing mounted on said drive housing, said induction-discharge housing having a plurality of generally cylindrical pump chambers arranged alongside one another, a plurality of plungers having free ends extending into respective pump chambers of said induction discharge housing, a crankshaft journalled in said drive housing for producing reciprocating movement of said plungers in said pump chambers, induction and discharge chambers for said induction-discharge housing, spring biased inlet and outlet valves respectively disposed between the induction and discharge chambers and high pressure seals disposed around the plungers to prevent substantial leakage from said pump chambers, wherein a low pressure seal is associated with each high pressure seal with said low pressure seals being located in a scavenge circulation said scavenge circulation being provided by connection passages extending between chambers accommodating the low pressure seals and the induction chamber.

Figure 2:
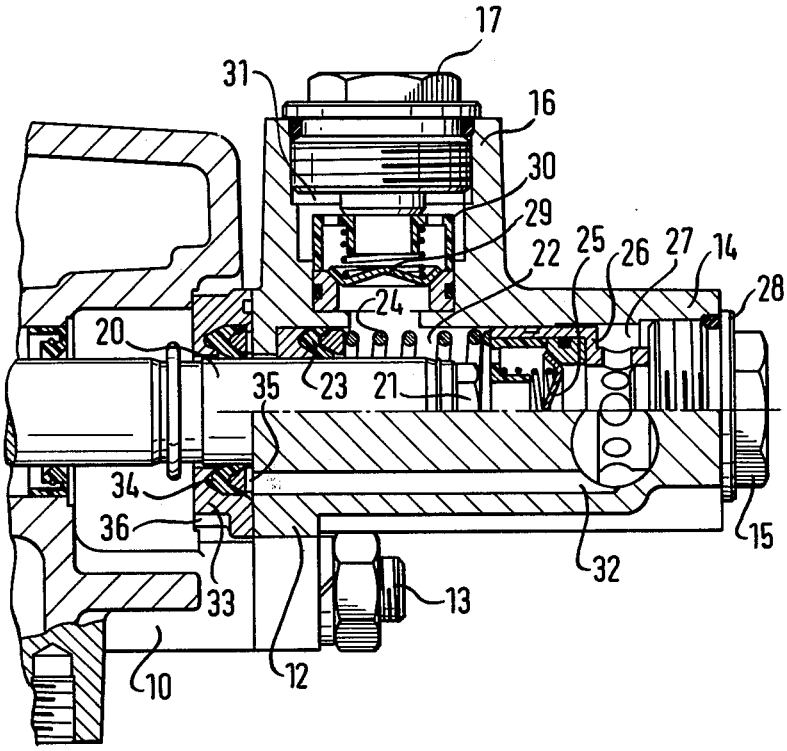

An embodiment of the invention will now be described by way of example and in more detail with reference to the drawings which show:

FIG. 1 a front view of a plunger pump with three plungers,

FIG. 2 a sectional view on the section line II—II of FIG. 1 and

Figure 3:
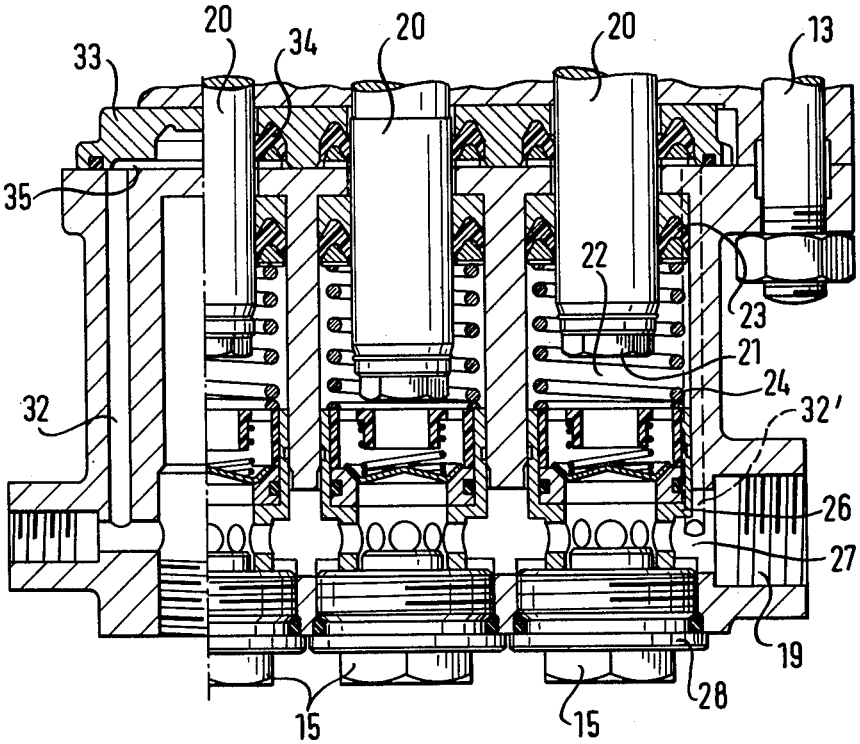

FIG. 3 a sectional view on the section line III—III of FIG. 1.

The front view of a plunger pump as shown in FIG. 1 shows a drive housing 10, a crankshaft 11 leading into the drive housing and an induction-discharge housing 12 which is mounted on the housing and secured thereto via several set screws 13.

The crankshaft is journalled within the drive housing 10 and drives the three plungers which are provided, and which extend into the induction-discharge housing 12, via a customary arrangement of connection rods and cross-heads.

FIG. 1 already shows the basic concept of free accessibility to the valves arranged within the induction-discharge housing 12. These valves, which will later be described in more detail, comprise inlet valves arranged in extensions of the pump chambers in which the plungers move and outlet valves which are arranged in a housing extension 16 which defines the discharge or pressure chamber. These valves and also further inbuilt components are each directly accessible via a respectively associated threaded plug 15, 17.

Discharge or pressure connections 18 are provided at the side endfaces of the housing extension 16 and induction or suction connections 19 are provided at the side endfaces of the pressure chamber extension 14. For the operation of the pump it is immaterial whether in each case both connections are used or whether only a single connection is used.

The sectional view of FIG. 2 shows a plunger 20 which can be moved to and fro within a pump chamber 22 of the induction-discharge housing 12. This plunger 20 preferably carries a ceramic sleeve **20*a* which is secured by means of a threaded fastener or nut 21 which allows the sleeve to be firmly clamped. A high pressure seal 23 is arranged at the point of entry of the plunger 20 into the pump chamber 22, i.e. at the base wall end of the pump chamber 22. This high pressure seal 23 is secured with a predetermined force by means of a compression spring 24. The end of the compression spring 24 which is remote from the seal is braced against a valve mount 26 associated with an inlet or suction valve 25. The valve mount in turn contacts the threaded plug 15 the working position of which is defined by an abutment collar 28. The induction or suction chamber which extends transverse to each of the three substantially identically constructed pump chambers of the pump is designated by the reference numeral 27**.

As a result of the support of the high pressure seal 23 via the spring 24 and the defined position of the threaded plug 15, which results from the abutment 28, the bias of the seal 23 is uniquely predetermined, i.e. it is not possible to obtain a bias pressure which is too low or too high during assembly or servicing provided that care is taken to ensure that the threaded plug 15 is tightened hard against its abutment.

In the event that the high pressure seal and/or the suction valve 25 has to be exchanged it is clear that only the threaded plug 15 needs to be released whereupon all the coaxially arranged parts can be withdrawn or pushed through the bore. Moreover, it is possible for the ceramic sleeve which is provided on the plunger 20 to be exchanged by releasing the securing screw 21. These servicing operations do not require any particular specialist knowledge and can accordingly also be carried out by the operator because faulty assembly is not possible providing the predetermined assembly sequence of the individual components is observed. Moreover, the required bias pressure for the high pressure seal is necessarily obtained on tightening the threaded plug 15.

Each of the discharge valves 29 can be exchanged in correspondingly simple manner by removing the respectively associated threaded plug 17 because, after removing this threaded plug 17 which is likewise provided with an abutment collar, the mount 30 for the discharge valve which engages in the discharge chamber 31 can be grasped without difficulty so that this valve can also be exchanged.

When operating the high pressure pump a certain degree of leakage via the high pressure seal 23 necessarily occurs at least after a certain time interval. This leakage is, to a certain degree, indeed desirable from the point of view of lubrication of the high pressure seal, it can however continuously increase in the course of time and lead to undesired dripping from the pump and to reduced performance.

A very important aspect of the present invention is the provision of self-lubrication for the seals that are necessary in conjunction with a practically complete avoidance of leakage into the open.

For this purpose a respective low pressure seal 34 is associated with each of the high pressure seals 23. The low pressure seals 34 are inserted into a scavenge circulation which comes from the induction chamber 27 and is returned again to the induction chamber 27 via connection passages 32, 32'.

The low pressure seals associated with the individual plungers 20 are arranged in a carrier part 33 which is sealingly retained against the induction-discharge housing 12 by being clamped between the drive housing 10 and the induction-discharge housing 12. For this purpose the drive housing 10 is provided with a recess 36 which accommodates the carrier part 33 and the carrier part 33 preferably has a certain degree of play within the recess 36 in order to ensure axial alignment without difficulties.

The sectional view of FIG. 3 shows in detail the self-lubrication-scavenge circuit which starts from the induction chamber 27, leads via a first passage 32 to the carrier part 33 which accommodates the low pressure seals 34, extends there from the side edge region into one end of a shallow channel 35 which extends substantially over the whole width of the carrier part and interconnects the recesses which accommodate the low pressure seals 34. The circuit is completed by a second passage 32' which is preferably symmetrically arranged relative to the passage 32 and which connects the other end of the shallow channel to the induction chamber 27. This arrangement results in a flow of liquid from the induction chamber to the individual low pressure seals as a result of the pulses which are formed in the induction chamber 27 or as a result of the low pressure difference which prevails there.

As the washing movement of the circulating liquid is ensured even at low pressure differences, the cross-sections of the connection passages 32, 32' can be made relatively large so that there is no danger of these passages blocking in operation.

The circulation also results in a desirable cooling of the seals which can then be kept always at at least substantially the temperature of the medium which is being forwarded. In this way the temperature difference between the temperature of the forwarded medium and the increased temperature of the seals which occurs with conventional pumps can be at least substantially avoided with the result that the permissible forwarding temperature can be raised without danger to the seals.

The avoidance of leakage into the open, in particular in conjunction with the avoidance of extraneous or additional lubrication, is a further important advantage so that seen as a whole the invention improves the function of the pump, raises the profitability and the operational reliability of the pump and simplifies its servicing.

The L-shaped form of the pump or induction-discharge housing is not only favourable from the manufacturing view point, in particular by automatic techniques, but also brings a considerable weight saving in comparison to customary induction-discharge housings which contributes to a reduction in the cost of manufacture.

In practice the induction-discharge housing is made either from a one piece forging or a one piece casting. In either case it will be seen that manufacturing is restricted to the following basic operations:

(a) Machining of flat faces at the joint face with the drive housing and at the end faces of the two limbs of the housing.

(b) Boring of the cylindrical bores which define the pump chambers and boring of the cylindrical passages which receive the discharge valves and are arranged at right angles to the pump chambers. These two sets of borings and the cutting of the associated threads for the threaded plugs 15 and 17 are readily made, despite the provision of various steps, because there are no undercuts.

(c) Boring of the passages which define the induction and discharge chambers and which extend at right angles to the pump chambers and to the bores which receive the discharge valves. It will be noted that these passages only need to break through the wall sections between adjacent bores or passages so that a minimum of material has to be removed.

(d) Finally, it is necessary to bore clearance holes in the lugs for the threaded fasteners 13 and, if provided, the first and second connection passages 32, 32'.

It will be appreciated that all machining operations can basically take place in three planes at right angles to each other which simplifies the manufacturing process.

The connection of the low weight induction discharge housing with the drive housing is unproblematic because the pressures occurring in the pump chambers are fully carried by the induction-discharge housing so that the set screws which join the drive housing and the induction-discharge housing are not additionally loaded with these pump chamber pressures.

Accordingly, the preferred arrangement requires only four set screws to join the induction-discharge housing and the drive housing. Two of these set screws or studs are usefully arranged in the plane of the longitudinal axes of the pump chambers laterally alongside the row of pump chambers and the remaining two are provided beneath and adjacent the row of pump chambers. The connection of the drive housing and the induction-discharge housing is also unproblematic because no special mating surfaces are required between these two housings as a result of the construction of the induction-discharge housing.

I claim:

1. A high pressure plunger pump for forwarding liquid at high pressures, the pump comprising a drive housing; an induction-discharge housing mounted on said drive housing, said induction-discharge housing having a plurality of generally cylindrical pump chambers arranged alongside one another; a plurality of plungers having free ends extending into respective pump chambers of said induction-discharge housing; a crankshaft journalled in said drive housing for producing reciprocating movement of said plungers in said pump chambers; induction and discharge chambers for said induction-discharge housing; and spring biased inlet and outlet valves respectively disposed between the induction and discharge chambers and the pump chambers, with said inlet valves being arranged alongside one another in axial extensions of the pump chambers and said outlet valves being arranged alongside one another to one side of said pump chambers, or vice versa; wherein said induction-discharge housing is a one piece housing of substantially L-shaped cross-section when viewed in a plane at right angles to said crankshaft, said L-shaped housing having first and second limbs and first and second ends extending in planes substantially at right angles to said crankshaft; wherein the inlet valves and the outlet valves are arranged in respective ones of said first and second limbs; wherein each of said inlet and outlet valves is secured in position by a respective threaded plug; wherein each of said induction and discharge chambers are passages of circular cross-section extending between said first and second ends of said housing, with the passage defining said induction chamber intersecting said axial extensions of said pump chambers; wherein respective high and low pressure seals are associated with each said plunger, said high pressure seals being arranged in said induction-discharge housing around said plungers adjacent said drive housing and said low pressure seals being positioned in a scavenge circulation established by first and second connection passages extending between chambers accommodating the low pressure seals and said induction chamber; wherein said low pressure seals are arranged between the induction-discharge housing and the drive housing, and wherein the low pressure seals are arranged in a carrier part there being recesses formed in this carrier part to accommodate the low pressure seals with said recesses being connected together via shallow channels for the purpose of ensuring the scavenge circulation.

2. A high pressure plunger pump in accordance with claim 1 and wherein said first and second connection passages are provided in said induction-discharge housing adjacent respective ends thereof.

3. A high pressure plunger pump in accordance with claim 1 and wherein the first and second connection passages extend through a base wall of the induction-discharge housing.

4. A high pressure plunger pump in accordance with claim 1 and wherein the carrier part is a separate member sealingly clamped between the drive housing and the induction-discharge housing.

5. A high pressure plunger pump in accordance with claim 1 and wherein said inlet valves are arranged in the axial extensions of the pump chambers.

6. A high pressure plunger pump in accordance with claim 1 and wherein at least that part of each plunger which engages in the associated pump chamber is provided with an exchangeable sleeve which is fixed on the plunger by means of a threaded fastener at the end face of the plunger and is exchangeable through the associated pump chamber extension.

7. A high pressure plunger pump in accordance with claim 1 and wherein each said plunger extends through a respective passage in a base wall of said induction-discharge housing adjacent said drive housing, said base wall forming a shoulder at the end of each said cylindrical bore thus defining pressure bearing support surfaces for the high pressure seals.

8. A high pressure plunger pump in accordance with claim 1 and wherein said L-shaped induction discharge housing is connected to said drive housing via lugs at the base of said induction discharge housing adjacent said drive housing.

9. A high pressure plunger pump in accordance with claim 8 and wherein threaded fasteners are used to secure said induction-discharge housing to said drive housing via said lugs and wherein first and second threaded fasteners are arranged at the ends of the induction-discharge housing in a plane containing the pump chambers and wherein further threaded fasteners are arranged to one side of the pump chambers opposite to said valves.

10. A high pressure plunger pump in accordance with claim 1 and wherein the high pressure seals are located at the bases of cylindrical bores formed in said induction discharge housing and defining, at least in part, said pump chambers, with each high pressure seal being braced against the base of the associated cylindrical bore via a spacer member and a valve mount of one of the associated valves by means of a respective one of said threaded plugs, and wherein these coaxially arranged components can be interchanged by removing the threaded plug.

11. A high pressure plunger pump, in accordance with claim 10 and wherein each spacer member comprises a compression coil spring and wherein the working position of the associated threaded plug is predetermined by a fixed abutment.

12. A high pressure plunger pump in accordance with claim 1 and wherein said induction chamber and said discharge chamber extend through said induction-discharge housing transverse to and intersecting the axes of the inlet and outlet valves respectively.

13. A high pressure plunger pump in accordance with claim 12 and wherein said induction and discharge chambers comprise cylindrical bores.

14. A high pressure plunger pump in accordance with claim 12 and wherein induction and discharge connections are provided at the end faces of the induction-discharge housing.

15. A high pressure plunger pump for forwarding liquid at high pressures, the pump comprising a drive housing; an induction-discharge housing mounted on said drive housing, said induction-discharge housing having a plurality of generally cylindrical pump chambers arranged alongside one another; a plurality of plungers having free ends extending into respective pump chambers of said induction-discharge housing; a crankshaft journalled in said drive housing for producing reciprocating movement of said plungers in said pump chambers; induction and discharge chambers for said induction-discharge housing; and spring biased inlet and outlet valves respectively disposed between the induction and discharge chambers and the pump chambers, with said inlet valves being arranged alongside one another in axial extensions of the pump chambers and said outlet valves being arranged alongside one another to one side of said pump chambers, or vice versa; wherein said induction-discharge housing is a one piece housing of substantially L-shaped cross-section when viewed in a plane at right angles to said crankshaft, said L-shaped housing having first and second limbs and first and second ends extending in planes substantially at right angles to said crankshaft; wherein the inlet valves and the outlet valves are arranged in respective ones of said first and second limbs; wherein each of said inlet and outlet valves is secured in position by a respective threaded plug, and wherein each of said induction and discharge chambers is a passage of circular cross-section extending between said first and second ends of said housing with the passage defining said induction chamber intersecting said axial extensions of said pump chambers, the pump further comprising inwardly projecting annular steps in said drive housing, respective high pressure seals seated on said annular steps, compression coil springs having first and second ends disposed concentrically within said pump chambers, with said first ends of said compression coil springs bearing on said high pressure seals and with said second ends bearing on said inlet valves, thereby biasing said inlet valves upwardly against said threaded plugs securing said inlet valves, and cooperating abutment means on said threaded plugs and on said L-shaped housing for defining the rest position of said threaded plugs.

16. A high pressure plunger pump according to claim 15, wherein said cooperating abutment means comprises annular flanges on said threaded plugs which cooperate with an outermost surface of the associated limb of said induction-discharge housing.

* * * * *